US005325555A

United States Patent [19]

Whitley

[11] Patent Number: 5,325,555

[45] Date of Patent: Jul. 5, 1994

[54] INELASTIC MATTRESS COVERING WITH AN ELASTIC UNDERSKIRT

[75] Inventor: John W. Whitley, Monroe, N.C.

[73] Assignee: Perfect Fit Industries, Inc., Monroe, N.C.

[21] Appl. No.: 45,643

[22] Filed: Apr. 9, 1993

[51] Int. Cl.[5] ..... A47G 9/04; A47G 9/02

[52] U.S. Cl. ..... 5/500; 5/497

[58] Field of Search ..... 5/497, 500, 502, 482, 5/495, 496; 297/224

[56] References Cited

U.S. PATENT DOCUMENTS

| | | | |
|---|---|---|---|
| 2,569,627 | 10/1951 | Black | 5/497 |
| 2,942,280 | 6/1960 | May, Jr. | 5/497 |
| 4,672,702 | 6/1987 | Isham | 5/497 |
| 4,703,530 | 11/1987 | Gusman | 5/497 |
| 4,962,546 | 10/1990 | Vitale | 5/497 |
| 4,980,941 | 1/1991 | Johnson, III | 5/497 |
| 4,985,953 | 1/1991 | Seago | 5/497 |

FOREIGN PATENT DOCUMENTS

| | | | |
|---|---|---|---|
| 0425466 | 5/1991 | European Pat. Off. | 5/497 |

*Primary Examiner*—Alexander Grosz

*Attorney, Agent, or Firm*—Panitch Schwarze Jacobs & Nadel

[57] ABSTRACT

A mattress covering in the form of a fitted mattress pad or fitted sheet having a top portion, an inelastic side skirt, and an elastic underskirt with the top portion dimensioned to fit a standard size mattress and the side skirt and underskirt being dimensioned to fit a range of mattress heights. The side skirt can be made of the same quilted or sheet material as the top portion for attractive appearance, or it can be made of other material, such as inexpensive single ply, non-woven, sheeting. The elastic underskirt can be made of three ply laminated material having a pair of inelastic outer plies gathered and bonded to an elastic inner ply. An elastic strand is secured in a peripheral fold in the underskirt to facilitate retention of the covering on a mattress.

21 Claims, 6 Drawing Sheets

INELASTIC MATTRESS COVERING WITH AN ELASTIC UNDERSKIRT

BACKGROUND OF THE INVENTION

The present invention relates generally to mattress coverings, such as mattress pads and sheets, and more particularly to a new and improved fitted mattress covering capable of practical and effective use with mattresses of a standard top surface size and standard range of heights.

Fitted mattress pads and sheets are commonly used and are available in various forms. Probably the simplest form of fitted sheet or mattress pad is one having the top and sides formed of the same material that is cut and sewn to fit a standard size or range of sizes of mattresses and has an elastic band or cord attached around the lower periphery to draw the lower edge of the covering under the mattress to retain the covering in fitted condition. The corners of this type of covering are either straight in the vertical direction or curved to facilitate pulling in under mattresses of varying heights. Such coverings have the advantage of ease of manufacture and the desirable appearance of the sides being of the same material as the top, e.g. quilted sides and top. They have the disadvantage, however, of utilizing only an elastic band to retain an otherwise inelastic covering on a mattress, and they have the disadvantage of being expensive to make the covering with the top surface material, e.g. quilted material, extending down through the sides sufficient to provide enough material to extend under a mattress of relatively high height so that the covering can be sold for use with mattresses of varying heights.

Another form of covering is a mattress pad that has a quilted top and a laminated multi-ply elastic side skirt that extends downwardly sufficiently to cover the sides and extends under mattresses of varying heights within a standard range for retention of the covering of the mattress. An elastic band or cord is attached to the lower periphery to facilitate retention of the covering on the mattress. Normally, such coverings are made with corners that are curved in the vertical direction to facilitate fitting under mattresses of varying height. Such mattress coverings have the disadvantage of a different, and less desirable, appearance of the sides due to the use of the laminated material rather than being able to use the same material, such as the sheet or quilted material of the top.

SUMMARY OF THE INVENTION

The present invention advantageously combines the desirable features of the different types of prior art mattress coverings without the disadvantages. Thus, the mattress covering of the present invention is capable of utilizing the same material on the sides as on the top and yet can economically limit the amount of side material by utilizing an elastic underskirt so that the more expensive top material need not extend under the mattress and can even terminate short of the bottom of the mattress when the covering is used with high mattresses. This elastic underskirt extends sufficiently to retain the covering in place and also allows the desirably appearing use of straight corner edges for the corners of the sides of the covering rather than the curved edges used with some types of prior art coverings.

Further, the invention provides the desirable versatility of providing coverings using different side skirt material for selected appearance or cost savings and yet using the practical and effective underskirt to retain the covering in place.

Briefly described, the mattress covering of the present invention includes a substantially inelastic top portion dimensioned to cover the top surface of mattresses of a predetermined standard top surface size. A substantially inelastic side skirt is secured to and extends generally perpendicularly from the periphery of the top portion and has corners extending generally straight and generally perpendicularly from the top portion for fitted disposition of the side skirt on the side walls and corners of any mattress of the standard top surface size and of a predetermined standard range of heights. An elastic underskirt is secured to and extends from the periphery of the side skirt an extent sufficient to extend under the side walls and corners of the highest height mattress of the standard height range to retain the top portion and side skirt in fitted relation on any mattress of the predetermined standard top surface size and predetermined standard height range. Preferably, an elastic strip is secured to and extends around the periphery of the underskirt to facilitate retention of the covering on a mattress.

The mattress covering can be a sheet with the top portion and side skirt formed of the same woven textile sheet material, or it can advantageously be in the form of a mattress pad having the top portion and side skirt formed of the same quilted textile sheet material.

Preferably, the side skirts extend from the top portion a distance substantially equivalent to the lowest height of the standard height range to substantially cover the side walls of the mattress, with a portion of the underskirt being used to cover the lower portion of the walls of mattresses of greater heights.

In the preferred embodiment the underskirt is formed of a three ply laminated textile fabric that includes a pair of outer inelastic plies gathered and bonded at spaced locations to an elastic inner ply.

To provide the generally perpendicularly straight corners for the side skirt, when made from the same material as the top portion, the material for the top portion and side skirt is formed with rectangular recesses in the corners with the sides of the recesses then being secured together to form the straight corners perpendicular to the top portion.

Thus, the present invention provides a mattress covering that can be made in various forms for desired appearance, minimal cost and effective fitting on a range of sizes of mattresses.

DETAILED DESCRIPTION OF THE PREFERRED EMBODIMENTS OF THE INVENTION

Figure 1:
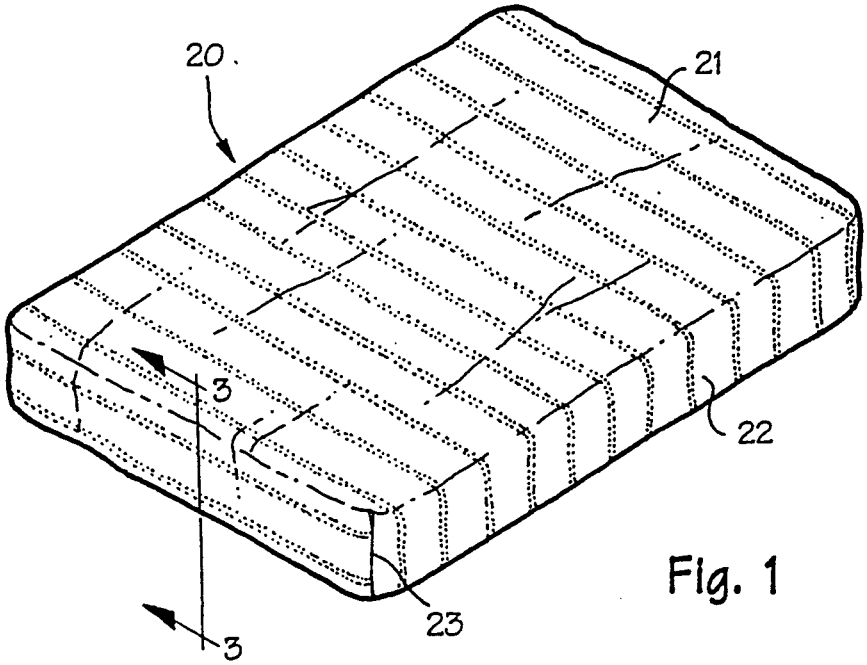
FIG. 1 is a perspective view of a mattress on which one form of the preferred embodiment of the mattress covering of the present invention is fitted.

One of the preferred embodiments of the mattress covering of the present invention is illustrated in FIGS. 1-7. In this form the mattress covering 20 is a mattress pad having a top portion 21 of conventional quilted mattress pad material. Integrally formed of the same material as and as an extension from the periphery of the top portion 21 is a side skirt 22. This side skirt 22 is formed with corners 23 that extend perpendicularly and straight from the top portion 21 to fit over the corners of a mattress. Secured to and extending from the periphery of the side skirt 22 is an underskirt 24 of elastic material. In the embodiment illustrated the elastic underskirt is a laminated three ply material including a pair of outer plies 25 and an elastic inner ply 26 to which the outer plies 25 are bonded at spaced locations. This construction can be of a type presently used as a side skirt in a known type of mattress pad, such as disclosed in U.S. Pat. No. 4,962,546. This underskirt is provided for extension under a mattress to draw the mattress pad 20 into fitting relation on a mattress and to retain the mattress pad on the mattress. To facilitate the retention of the mattress pad 20 on the mattress, a conventional strand 27 of elastic material is secured in a peripheral fold 28 of the underskirt 24 in a conventional arrangement.

Figure 3:
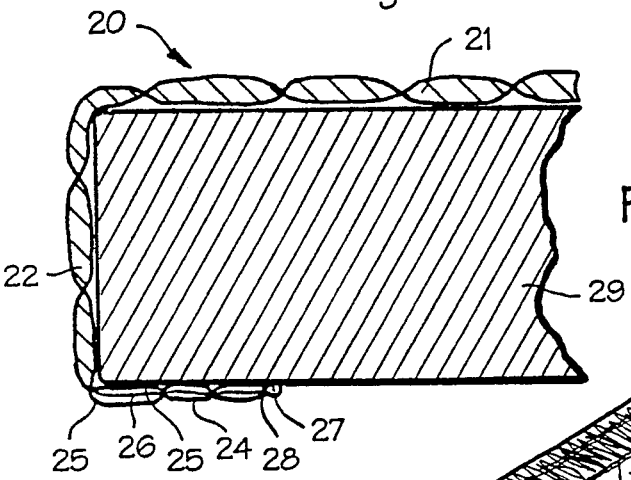
FIG. 3 is a partial vertical sectional view taken along line 3—3 of FIG, 1.
Figure 2:
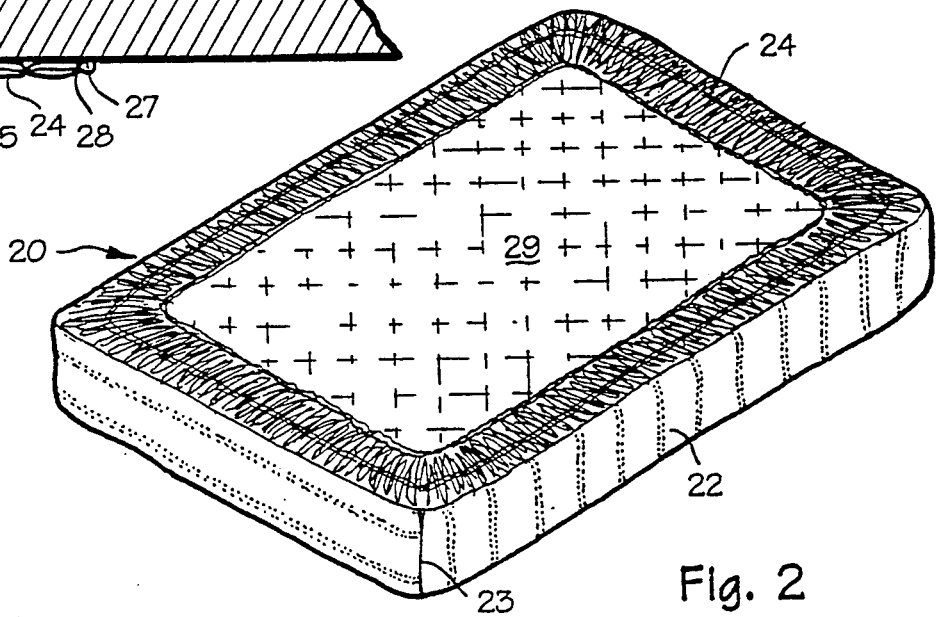
FIG. 2 is a perspective view of the mattress and covering of FIG. 1 as viewed looking toward the bottom of the mattress and covering.

With this combination side skirt 22 and underskirt 24 construction, the mattress pad 20 is capable of practical and effective use on standard size mattresses within a relatively wide range of heights. As illustrated in FIGS. 1, 2 and 3, the mattress pad 20 is fitted on a mattress 29 with the top portion 21 of the mattress pad 20 having length and width dimensions substantially the same as the standard dimensions of the type mattress on which the pad is to be used, and the side skirt 22 extends downwardly from the top portion 21 an extent substantially the same as an intermediate height mattress within a predetermined standard range of heights. As can be seen in the drawings, both the top and the sides of the mattress are formed with the same attractive quilted material, which extends down only to the bottom of the side walls of the mattress, with the underskirt 24 being hidden under the mattress. This reduces to a minimum the amount of quilted material that must be used in making the mattress pad of this particular size and provides an underskirt 24 of sufficient extent to effectively draw the mattress pad 20 into fitted disposition with the straight corners 23 fitting neatly at the corners of the mattress.

Figure 4:
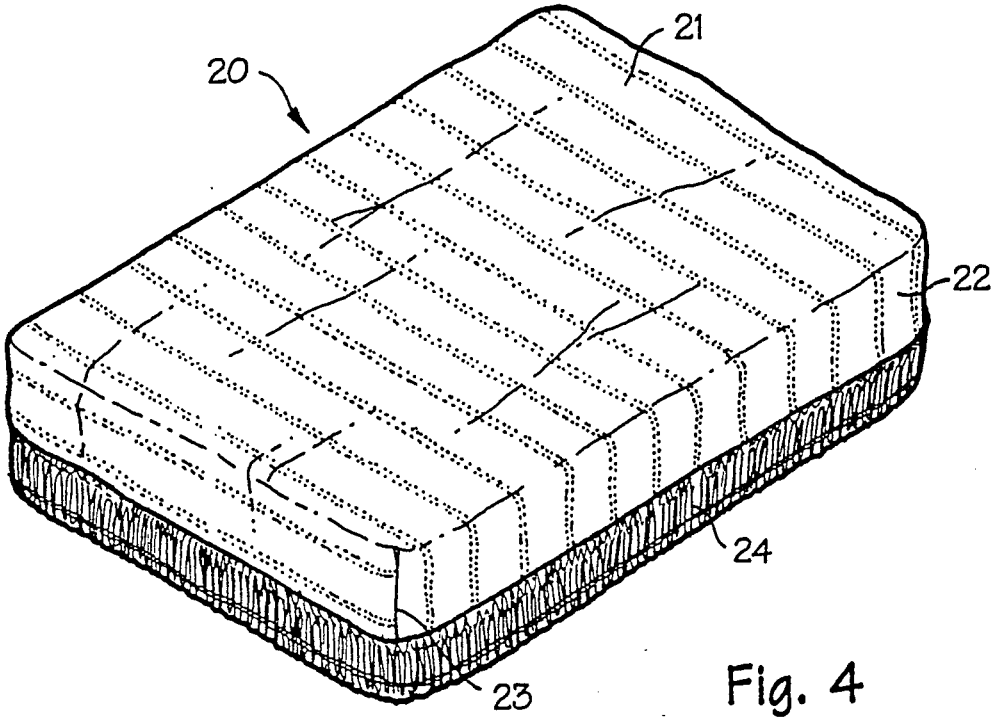
FIG. 4 is a perspective view showing the mattress covering of FIG. 1 fitted on a mattress of a higher height than the mattress of FIG. 1.
Figure 5:
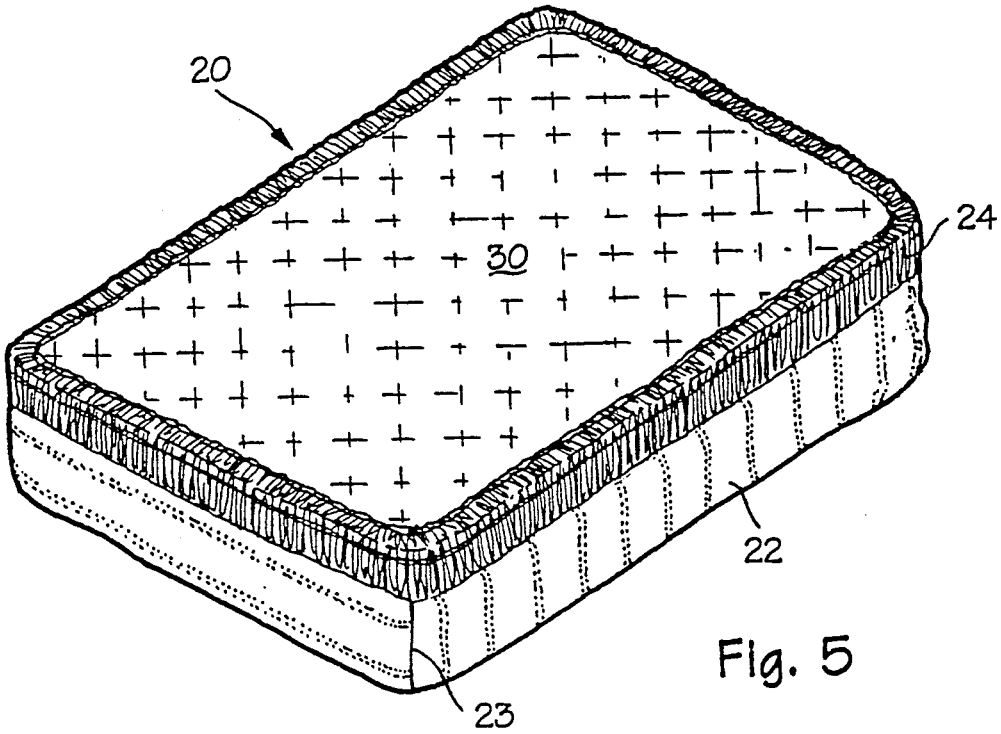
FIG. 5 is a perspective view of the mattress and covering of FIG. 4 as viewed looking toward the bottom of the mattress.

In FIGS. 4 and 5, the same mattress pad 20 used with the intermediate height mattress in FIGS. 1, 2 and 3 is shown fitted on a mattress 30 of a height corresponding to the generally highest height of the standard range of heights for the mattress size for which the pad 20 is adapted. In this application, the side skirt 22 extends down to a location short of the bottom of the mattress sides and the underskirt 24 extends downwardly covering the remainder of the mattress sides and continues under the mattress 30 an extent sufficient to provide sufficient elasticity to draw the mattress pad 20 into fitted relation and to retain the pad 20 on the mattress.

Figure 6:
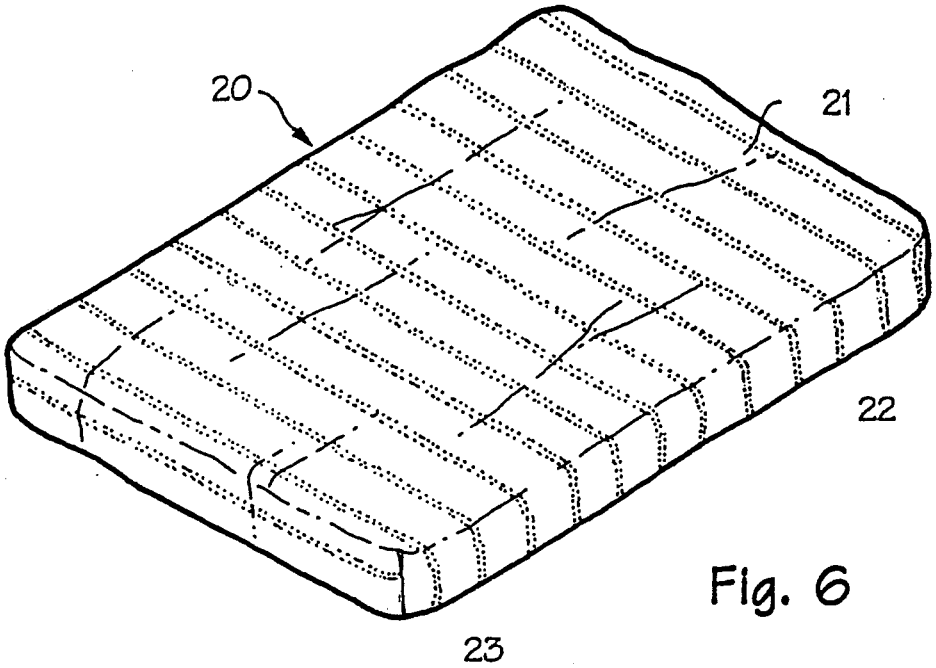
FIG. 6 is a perspective view of the mattress covering of FIG. 1 fitted on a mattress of a lower height than the mattress of FIG. 1.
Figure 7:
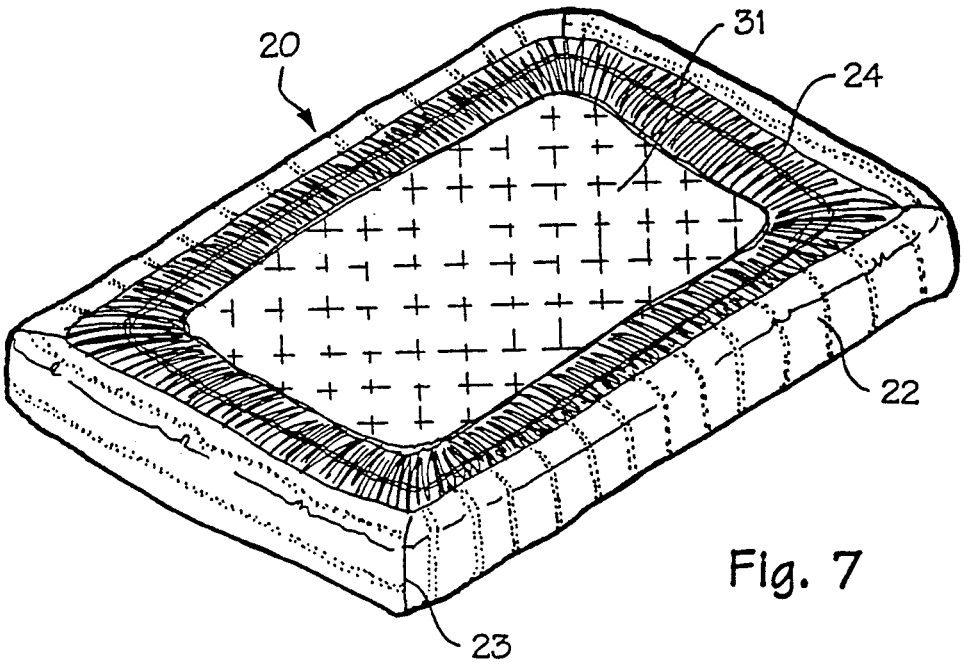
FIG. 7 is a perspective view of the mattress and covering of FIG. 6 as viewed looking toward the bottom of the mattress.
Figure 8:
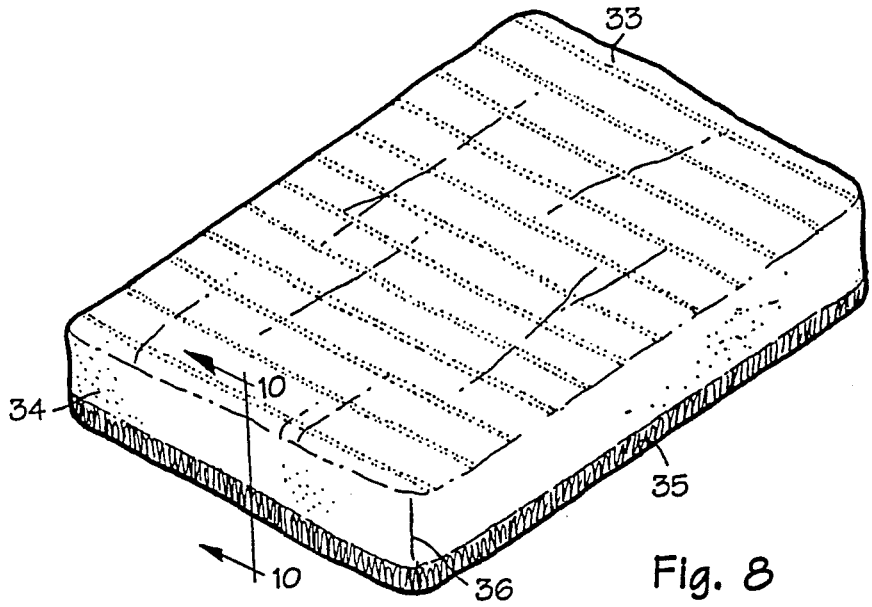
FIG. 8 is a perspective view of a mattress covering of another form of the preferred embodiment of the present invention fitted on a mattress.
Figure 10:
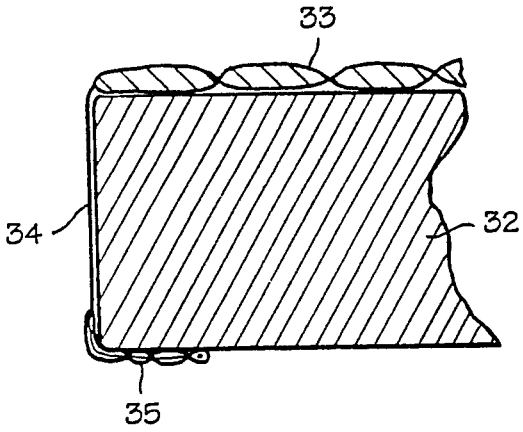
FIG. 10 is a partial vertical sectional view taken along line 10—10 of FIG. 8.
Figure 9:
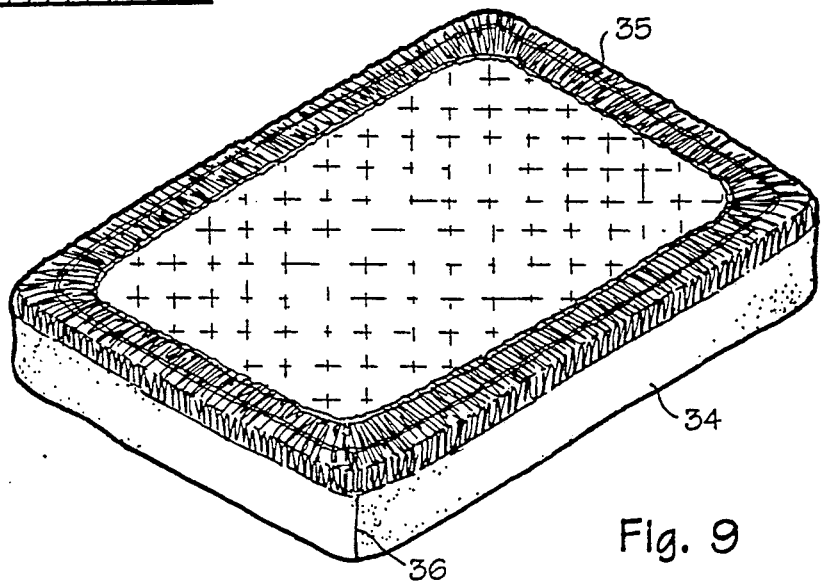
FIG. 9 is a perspective view of the mattress and covering of FIG. 8 as viewed looking toward the bottom of the mattress.

In FIGS. 6 and 7, the same mattress pad 20 is illustrated fitted on a mattress 31 of a thickness corresponding generally to the lowest height of the standard range of heights of the mattress type on which the pad 20 is adapted to be used. In this application, the side skirt 22 extends from the top portion 21 a distance greater than the height of the mattress and, therefore, extends under the mattress 31, with the underskirt 24 extending further under the mattress to draw the mattress pad 20 into fitted relation on the mattress 31.

In another form of the preferred embodiment of the present invention, the mattress pad 32 has the same type of quilted top portion 33 as the mattress pad 20 of the previously described embodiment, but, instead of having a side skirt 22 formed of the same quilted material as the top portion, it has a side skirt 34 formed of a conventional single ply, non-woven, sheet material of the same general dimensions as the side skirt 22 of the previously described embodiment and has secured to and extending from its periphery an underskirt 35 of the same type and dimensions as the underskirt 24 of the previously described embodiment. This embodiment has the same vertical, straight corners 36 as in the preceding embodiment and the same fitting characteristics and versatility, but it is less expensive to manufacture due to the use of an inexpensive single ply, non-woven, side skirt 34 rather than a quilted side skirt 22 of the previously described embodiment.

Figure 11:
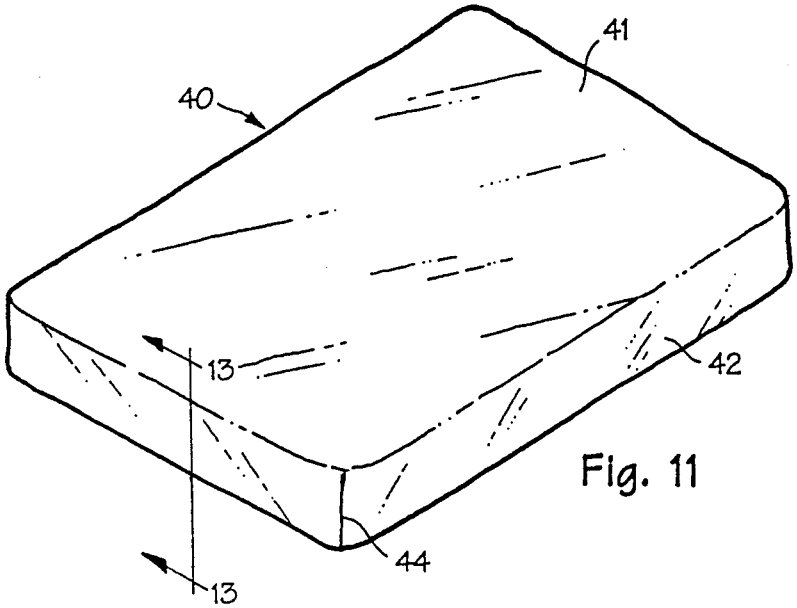
FIG. 11 is a perspective view of a mattress covering of a further form of the preferred embodiment of the present invention fitted on a mattress.
Figure 13:
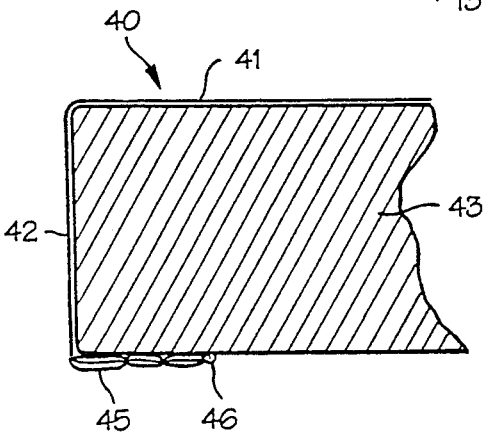
FIG. 13 is a partial vertical sectional view taken along line 13—13 of FIG. 11.
Figure 12:
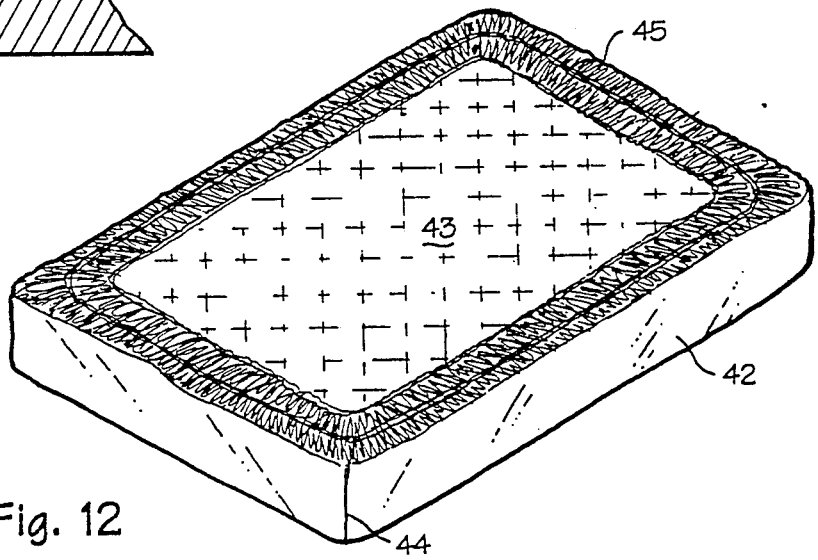
FIG. 12 is a perspective view of the mattress and covering of FIG. 11 as viewed looking toward the bottom of the mattress.

The mattress covering of the present invention can also take the form of a fitted sheet as well as a mattress pad. The form of the preferred embodiment as a fitted sheet 40 is illustrated in FIGS. 11, 12 and 13. In this embodiment the fitted sheet 40 has a top portion 41 dimensioned generally the same as the top surface of a mattress of the type on which it is to be used. This top portion 41 is formed of conventional bed sheet material. A side skirt 42 extends integrally from the periphery of the top portion 41 a distance generally the same as the height of an intermediate height mattress of a standard range of height mattresses so as to provide a covering for substantially the entire side of the mattress 43. The corners 44 of the side skirt 42 extend perpendicularly and straight from the top portion 41 in a manner similar to the extent of the corners of the previously described embodiments. Extending from the periphery of the side skirt 42 for fitting under the mattress 43 is an underskirt similar to the laminated, three ply, elastic underskirt 24 of the previously described embodiments, which includes an elastic strand 46 secured in a fold of its outer periphery for facilitating retention of the sheet 40 in fitted disposition on the mattress 43.

In making the mattress pads 20 and 23 or the fitted sheet 40, the straight, perpendicularly extending corners 23,36 of the mattress pads and corners 44 of the fitted sheet 40 are formed by providing square recesses 50 in the material 51 of which the top portions and side skirts are formed. This material 51 with square recesses 50 in the corners can be made from a single piece of quilted material in making the mattress pad 20 described above or of woven single ply sheeting material in making the fitted sheet 40 described above.

Figure 14:
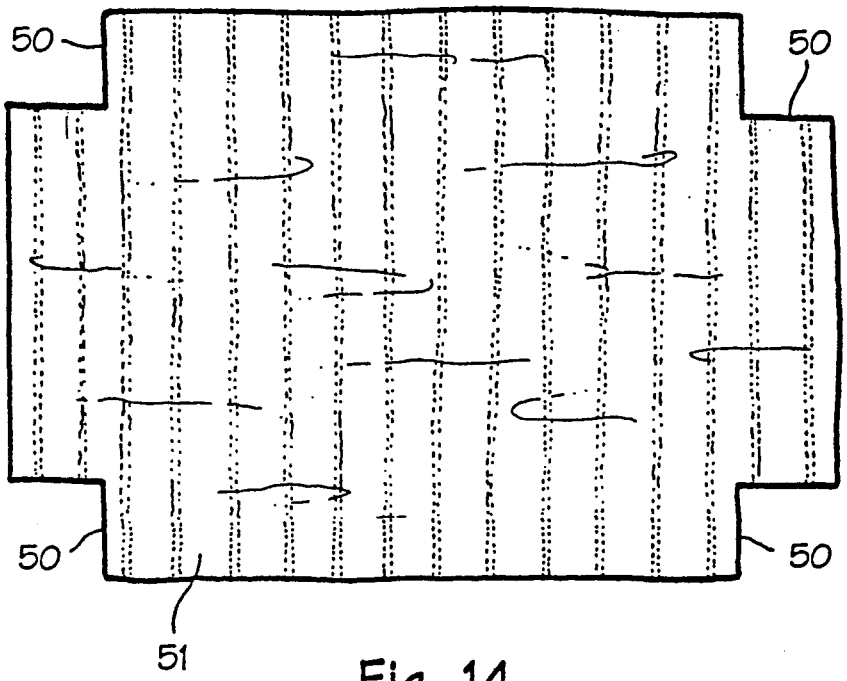
FIG. 14 is a plan view of quilted sheet material formed for use in providing the top portion and side skirt of the mattress covering illustrated in FIG. 1.

In making a mattress pad 32 having a side skirt 34 formed of material different than the material of the top portion 33, which can also be done with the fitted sheet construction, the width of material for making the side skirt can be secured by sewing to the rectangular piece of material that forms the top portion with the side skirt portion being formed in four strips, two of which have the same length as the length of the top portion and two of which have the same length as the ends of the top portion, thereby leaving square recesses at the corners of the composite material after the side skirt material is sewn to the top portion, with the same resulting configuration as illustrated in FIG. 14.

Figure 15:
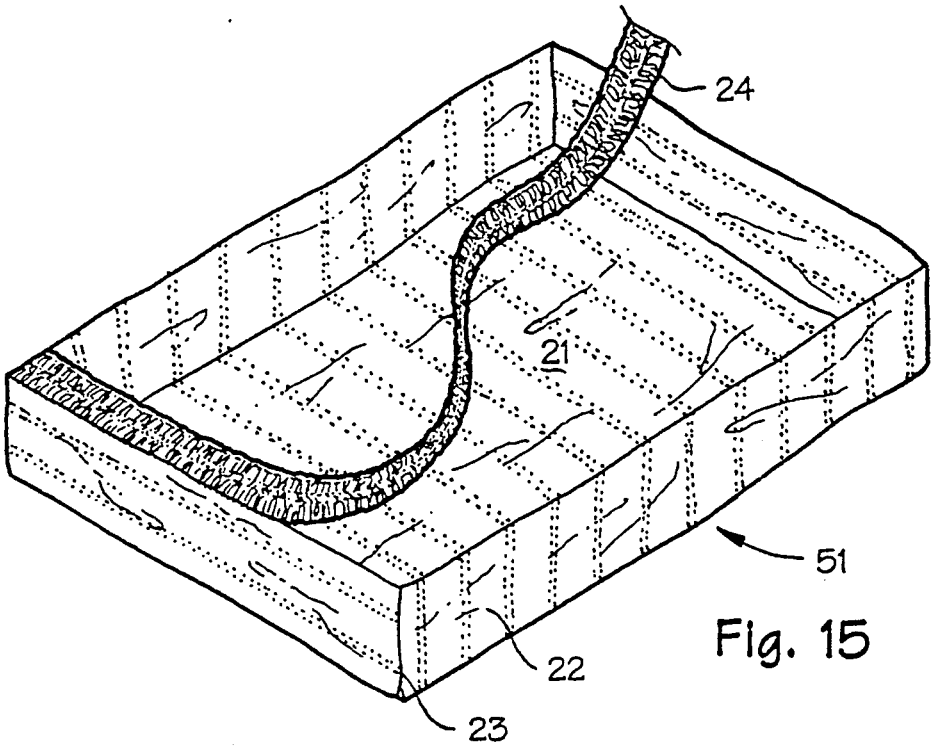
FIG. 15 is a perspective view of a partially manufactured covering of the type illustrated in FIG. 1.

After the material is formed with the square recesses at the corners, the portions that form the side skirt are turned down vertically so that the edges of the recesses abut each other. These edges are then sewn together to form the corners 23,36 and 44 extending perpendicularly and straight from the top portion 21, 33 and 41. A strip of material forming the underskirt 24, 35 and 45 is then sewn (FIG. 15) around the periphery of the side skirt 22, 34 and 42, with this material having the elastic strand 27 and 46 previously sewn into the folded outer edge of the underskirt 24, 35 and 45.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A mattress covering comprising:

a substantially inelastic top portion dimensioned to cover the top surface of mattresses of a predetermined standard top surface size;

a substantially inelastic side skirt extending generally perpendicularly from the periphery of said top portion and having corners extending generally straight and generally perpendicularly from said top portion for fitted disposition of said side skirt on the side walls and corners of any mattress of said standard top surface size and a predetermined standard range of heights; and an elastic underskirt extending from the periphery of said side skirt an extent sufficient to extend under the side walls and corners of the highest height mattress of said standard height range to retain said top portion and said side skirt in fitted relation on any mattress of said predetermined standard top surface size and predetermined standard height range.

2. A mattress covering according to claim 1 and characterized further by an elastic strand secured to and extending around the periphery of said underskirt to facilitate retention of said covering on a mattress.

3. A mattress covering according to claim 1 and characterized further in that said side skirt extends from said top portion said distance substantially equivalent to said lowest height of said predetermined range.

4. A mattress covering according to claim 1 and characterized further in that said covering is a fitted sheet.

5. A mattress covering according to claim 4 and characterized further in that said top portion and said side skirt are formed of the same woven textile sheet material.

6. A mattress covering according to claim 1 and characterized further in that said covering is a mattress pad.

7. A mattress covering according to claim 6 and characterized further in that said top portion and said side skirt are formed from the same quilted textile sheet material.

8. A mattress covering according to claim 6 and characterized further in that said top portion is made of quilted material and said side skirt is formed of single ply, non-woven, sheeting material.

9. A mattress covering according to claim 8 and characterized further by an elastic strand secured to and extending around the periphery of said underskirt to facilitate retention of said covering on a mattress.

10. A mattress covering according to claim 1 and characterized further in that said underskirt is a three ply laminated textile fabric comprising a pair of outer inelastic plies gathered and bonded at spaced locations to an elastic inner ply.

11. A mattress covering according to claim 10 and characterized further by an elastic strand secured to and extending around the periphery of said underskirt to facilitate retention of said covering on a mattress.

12. A mattress covering according to claim 6 and characterized further in that said underskirt is a three ply laminated textile fabric comprising a pair of outer inelastic plies gathered and bonded at spaced locations to an elastic inner ply.

13. A mattress covering according to claim 7 and characterized further in that said underskirt is a three ply laminated textile fabric comprising a pair of outer inelastic plies gathered and bonded at spaced locations to an elastic inner ply.

14. A mattress covering according to claim 8 and characterized further in that said underskirt is a three ply laminated textile fabric comprising a pair of outer inelastic plies gathered and bonded at spaced locations to an elastic inner ply.

15. A mattress covering according to claim 5 and characterized further in that said corners are formed by rectangular recesses in the corners of the sheet material of which the top portion and side skirt are formed, with the side of the recesses being secured together to form said corners generally straight and generally perpendicular to said top portion.

16. A mattress covering according to claim 15 and characterized further by an elastic strand secured to and extending around the periphery of said underskirt to facilitate retention of said covering on a mattress.

17. A mattress covering according to claim 7 and characterized further in that said corners are formed by rectangular recesses in the corners of the sheet material of which the top portion and side skirt are formed, with the side of the recesses being secured together to form said corners generally straight and generally perpendicular to said top portion.

18. A mattress covering according to claim 17 and characterized further by an elastic strand secured to and extending around the periphery of said underskirt to facilitate retention of said covering on a mattress.

19. A mattress covering according to claim 10 and characterized further in that said corners are formed by rectangular recesses in the corners of the sheet material of which the top portion and side skirt are formed, with the side of the recesses being secured together to form said corners generally straight and generally perpendicular to said top portion.

20. A mattress covering according to claim 19 and characterized further by an elastic strand secured to and extending around the periphery of said underskirt to facilitate retention of said covering on a mattress.

21. A mattress covering comprising:

a substantially inelastic, generally rectangular top portion dimensioned to cover a top surface of mattresses of a predetermined standard top surface size;

a substantially inelastic side skirt extending generally perpendicularly from the periphery of said top portion and having corners extending generally straight and generally perpendicularly from said top portion so as to provide fitted disposition of said side skirt on side walls and corners of any mattress of said standard top surface size;

an elastic underskirt extending away from the periphery of said side skirt; and a separate elastic strand secured to and extending around the periphery of said elastic underskirt.

* * * * *